US006755181B2

(12) United States Patent
Aubourg

(10) Patent No.: US 6,755,181 B2
(45) Date of Patent: Jun. 29, 2004

(54) METHOD FOR CONTROLLING THE AMOUNT OF FUEL INJECTED IN A DIRECT INJECTION INTERNAL COMBUSTION ENGINE

(75) Inventor: Alain Aubourg, Saint-Jean (FR)

(73) Assignee: Siemens VDO Automotive, Toulouse Cedex (FR)

( * ) Notice: Subject to any disclaimer, the term of this patent is extended or adjusted under 35 U.S.C. 154(b) by 0 days.

(21) Appl. No.: 10/363,311

(22) PCT Filed: Aug. 7, 2001

(86) PCT No.: PCT/EP01/09120

§ 371 (c)(1),
(2), (4) Date: Mar. 3, 2003

(87) PCT Pub. No.: WO02/20968

PCT Pub. Date: Mar. 14, 2002

(65) Prior Publication Data

US 2003/0188717 A1 Oct. 9, 2003

(30) Foreign Application Priority Data

Sep. 4, 2000 (FR) ..... 00 11237

(51) Int. Cl.[7] ..... F02M 51/00
(52) U.S. Cl. ..... 123/478; 123/480

(58) Field of Search ..... 123/478, 480, 123/294, 485

(56) References Cited

U.S. PATENT DOCUMENTS

| | | | | |
|---|---|---|---|---|
| 5,381,297 A | | 1/1995 | Weber | |
| 5,531,198 A | * | 7/1996 | Matsuura | 123/294 |
| 5,605,136 A | | 2/1997 | Nakashima | |
| 6,076,508 A | | 6/2000 | Kanano | |
| 6,092,509 A | | 7/2000 | Tanabe et al. | |

FOREIGN PATENT DOCUMENTS

| | | |
|---|---|---|
| EP | 0 893 594 A2 | 1/1999 |
| EP | 1 002 948 A2 | 5/2000 |

* cited by examiner

*Primary Examiner*—Bibhu Mohanty
(74) *Attorney, Agent, or Firm*—Young & Thompson

(57) ABSTRACT

The invention concerns a method which consists in using an injector supplied with fuel whereof the pressure ($P_{carb}$) is an increasing function of the amount of fuel (Q) to be injected, the opening of the injector being electromagnetically triggered by energizing the electric coil integral with the injector with a current peak of predetermined duration ($T_1$). The invention is characterized in that the duration ($T_1$) of the current peak in an increasing function of the pressure ($P_{carb}$) of the fuel. Thus, the dynamics of the injector is increased.

6 Claims, 1 Drawing Sheet

Figure 1:
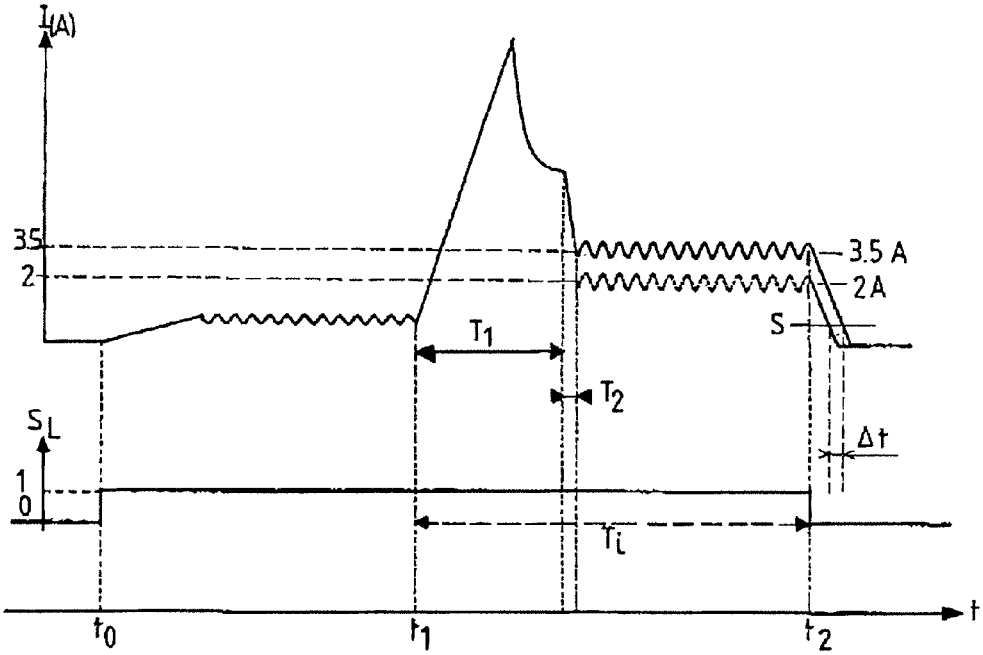

METHOD FOR CONTROLLING THE AMOUNT OF FUEL INJECTED IN A DIRECT INJECTION INTERNAL COMBUSTION ENGINE

The present invention relates to a method for controlling the amount of fuel injected into a direct-injection internal combustion engine. More especially, the invention relates to such a method employed using an injector supplied with fuel under pressure, the opening of said injector being triggered electromagnetically by supplying an electric coil that forms part of the injector with a current spike of predetermined duration.

Electromagnetically operated fuel injectors are well known, as is the method for controlling such an injector mentioned hereinabove (see, for example, U.S. Pat. No. 5,381,297). It is known that such an injector comprises a needle that can move under the action of an electromagnetic field developed by an electric coil supplied with a suitable current, between a position in which one end of this needle closes off an opening pierced in the seat defining a passage for a fuel to be injected into an internal combustion engine cylinder and a position in which the needle uncovers this opening to allow such injection. At rest, the needle is pressed against its seat by a preloading spring and by the pressure of the fuel let into the injector. To overcome this load, and allow the injector to open, it is necessary for the coil to be supplied fleetingly with a strong current, of the order of some ten amps for example, the current spike thus applied being followed by the application of a lower current holding the injector open for a time which is modulated according to the amount of fuel to be injected.

When such an injector is used to supply gasoline to a cylinder of a direct-injection internal combustion engine, it is currently desirable to have the possibility of adjusting this amount of fuel in a wide range. Indeed, when such an engine is operating at light load with a fuel-lean and stratified air/fuel mixture, the amount of gasoline to be injected needs to be very low. By contrast, at high speed and full load, a great amount of gasoline needs to be injected into the engine in a very short time, shorter than 5 ms at 6000 rpm. The ratio of the extreme fuel flow rates, or "dynamic range" of the injector needs therefore to be very high, advantageously of the order of 20.

In order to get close to this value, it has been proposed for the pressure of the gasoline delivered to the injector to be increased when the injector needs to deliver a great deal of gasoline. Thus, for example, the injector is supplied with gasoline at a pressure of 50 bar for small amounts of gasoline to be injected, and at 110 bar for higher amounts. In this way it has been possible to obtain a dynamic range of about 15, which is still considered to be insufficient.

It is therefore an object of the present invention to provide a method for controlling the amount of fuel injected into a direct-injection internal combustion engine by an injector with a high dynamic range, typically of the order of 20.

This object of the invention together with others which will become apparent from reading the description which will follow, is obtained using a method for controlling the amount of fuel injected into a direct-injection internal combustion engine by an injector supplied with fuel under pressure, the opening of said injector being triggered electromagnetically by supplying an electric coil that forms part of the injector with a predetermined current spike, this method being notable in that said duration of said current spike is an increasing function of said fuel pressure.

As will be seen in detail further on, this method makes it possible to widen the range of values of amounts of fuel injected, both at the small quantity end and at the highest quantity end.

According to another feature of the method according to the invention, the duration of said current spike is also an increasing function of the duration of a predetermined injector-open time.

Figure 2:
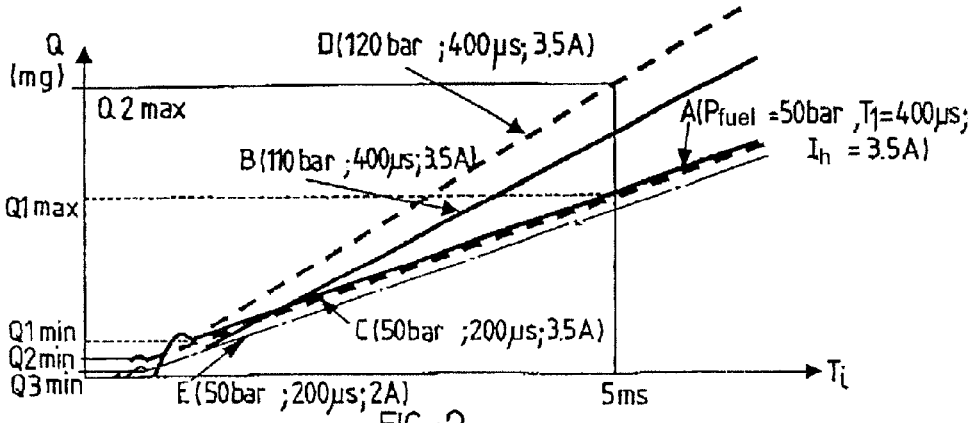

Other features and advantages of the present invention will become apparent from reading the description which will follow and from examining the appended drawing in which:

FIG. 1 is a graph showing the change with respect to time 1) of the current in the coil of an injector controlled according to the present invention for regulating the injector-open time, and 2) of a logic injector control signal, and FIG. 2 depicts graphs showing the change in the amount of fuel delivered by the injector as a function of its open time, under various injector operating conditions, these graphs providing an illustration and an explanation of the performance of the method of control according to the invention.

Reference is made to FIG. 1 of the appended drawing which depicts a graph of the change of the strength I of the electric current established by the method according to the invention in the coil of an electromagnetically controlled fuel injector for opening this injector and closing it after it has delivered, to a cylinder of a direct-injection internal combustion engine, a predetermined amount Q of gasoline. Conventionally, this amount is determined by an engine management unit on the basis of engine operating parameters such as the engine intake air pressure, the engine speed, etc, and parameters representing the torque demands made by the driver, in a motor vehicle propelled by the engine, it being possible for these demands to be determined through the degree to which a throttle pedal, for example, is depressed.

The profile with respect to time of the current I depicted in FIG. 1 is controlled and calculated by an injector control circuit itself supplied with suitable signals from a microprocessor forming part of the management unit. To do this, the microprocessor emits a logic signal $S_L$ (see FIG. 1) defining the total duration $(t_2-t_0)$ for which the coil is energized with the current I to command the opening of the injector for a predetermined time $T_i$ calculated by the management unit as a function of the amount of fuel to be injected into a cylinder of the engine.

The overall shape of the profile of the current I is classic. Thus, as a preference, upon switching (at $t_0$) of the signal $S_L$ signaling to the injector control circuit a demand to open the injector which demand is formulated by the management unit, the control circuit sends a "precharge" current into the injector coil to allow energy to be stored in this coil to facilitate the effective subsequent opening of the injector, at a predetermined moment $t_1$, as will be seen later on. To do this, the current in the coil during the period $(t_1-t_0)$ is stabilized at a roughly constant value, just high enough not to trigger the opening of the injector.

The precharge current is established in this coil by applying between the terminals thereof a chopped voltage which gives the current the sawtooth profile depicted in FIG. 1. Such a supply, described in the aforementioned U.S. Pat. No. 5,381,297, is advantageous in that it benefits from the self-induction current which develops in the injector coil to limit the electrical power consumed during the subsequent current spike.

At the moment $t_1$, by applying a voltage pulse of appropriate duration to the coil, the injector control circuit shapes the current admitted to the coil according to the current spike of duration $T_1$ depicted in FIG. 1. The rise in current in the coil is advantageously rapid, because of the precharging of the coil, and culminates for example in a value of about 11 amps and a voltage of about 70 V. This speed causes immediate effective opening, at the moment $t_1$, of the injector, by yanking the injector needle off the seat onto which it is pressed by a spring and by the pressure of the fuel. The yanking force is applied electromagnetically to this needle using magnetic flux developed in the coil (along the axis of which the needle is placed) through the sharp rise in the current in this coil at the moment $t_1$. The open time $T_i$, calculated beforehand by the management unit, is then counted down by the control circuit from the moment $t_1$ until the moment $t_2$ such that $t_2=t_1+T_i$, at which moment the injector has to close again so that the amount of fuel injected in the time interval $(t_2-t_1)$ is compliant with that established by the management unit.

To ensure sharp and precise closure of the injector at the moment $t_2$, the current then passing through the coil needs to be as low as possible. This is why, after the current spike of duration $T_1$, the current is returned, in a rapid-decrease step of duration $T_2$, to a lower value, of a few amps, but nonetheless sufficient to keep the injector open during a predetermined length of time. The roughly constant "hold" current $I_h$ is also established by applying a chopped voltage to the injector coil. The time $T_2$ is a function of $T_1$ and of the voltage of the source of electrical power that powers the injector, namely the voltage of the battery in the case of an engine mounted in a motor vehicle.

The duration $T_1$ of the spike current is, in the known way, a function of the injector-open time $T_i$, predetermined by the management unit, otherwise known as the "injection time". According to one characteristic of the present invention, this duration $T_1$ is also an increasing function of the pressure of the fuel supplied to the injector.

Reference is made to the graphs of FIG. 2 of the attached drawing to explain and justify this characteristic of the method according to the present invention.

A represents the graph (in solid line) of the change in the amount of fuel Q (measured in milligrams for example) delivered by the injector, as a function of the duration $T_i$ of the injector-open time, in the classic case where the pressure $P_{fuel}$ of the fuel is fixed, of the order of 50 bar and where the duration $T_1$ of the injector opening current spike is also fixed, of the order of 400 $\mu$s, while the holding current $I_h$ is 3.5A.

This graph has a linear part in which the amount Q1 of fuel can be adjusted with a dynamic range $Q1_{max}/Q1_{min}$ of the order of 10, at the most, as was seen earlier on.

As was seen earlier on too, by raising the fuel pressure, for example to 110 bar (graph B), the maximum amount of fuel injected under heavy load at high speed can be raised ($T_i$ is then of the order of 5 ms). The dynamic range achieved is then of the order of 15.

According to the present invention, the proposal is to vary the fuel pressure and the duration $T_1$ of the current spike as a function of the load on the engine.

At light loads use is then made of a modest fuel pressure, of the order of 50 bar for example, and a current spike of shortened duration, for example 200 $\mu$s, with a holding current of 3.5 A for example.

These conditions correspond to graph C (in broken line) of FIG. 2. The preload of the spring pressing on the injector needle is such as to set the value $Q2_{min}$ of the smallest injectable amount of fuel as low as possible so as to increase the dynamic range on the adjustment of the amount of fuel, this value $Q2_{min}$ being markedly lower than the corresponding value $Q1_{min}$ obtained when the spring is preloaded with $T_1$=400 $\mu$s.

The minimum amount of fuel delivered can be lowered further to a value $Q3_{min}<Q2_{min}$, identified on graph E in FIG. 2, established under the same fuel pressure and current spike duration conditions (50 bar and 200 $\mu$s respectively) as graph C. This result is achieved by lowering the holding current as illustrated in FIG. 1, for example from 3.5 A (graph in solid line) to 2.5 A (graph in broken line). As the decrease in the current from the moment $t_2$ onwards is with the same gradient in both cases, the graph in broken line passes through the injector-closure threshold S sooner than the graph in solid line. This results in a shortening (by $\Delta t$) of the effective injector-open duration and therefore in a reduction in the amount of fuel injected, particularly in the minimum amount Q3 min of fuel injected.

By thus setting the value of the holding current when the fuel pressure is relatively low (50 bar) to a lower value than when this pressure is relatively high (200 bar), namely by causing the value of the current to increase with fuel pressure, the dynamic range of adjustment of the amount of fuel delivered is increased still further, in accordance with the goal pursued by the present invention.

Under heavy loads (where $T_i$~5 ms) delivery to the fuel injector is at high pressure, for example 120 bar, and the duration of the current spike is raised to $T_1$=400 $\mu$s, the holding current being set to 3.5 A.

The characteristic $Q=f(T_i)$ then obtained corresponds to graph D in FIG. 2. This graph shows that the maximum amount of fuel $Q2_{max}$ deliverable by the injector is greatly raised, by comparison with the amounts given by the graphs of figures A, B and C. This maximum amount of fuel $Q2_{max}$ could be raised still further by extending the duration of the current spike to $T_1$=600 $\mu$s for example.

It will be noted that the drop in the preload of the spring mentioned hereinabove makes it possible to raise the pressure of the fuel deliverable to the injector still further (from 110 to 120 bar for example, see graphs B and D) although still allowing the injector to open, and this is favorable to increasing the dynamic range of the adjustment of the amount of fuel to be injected.

Thus, by combining the injection characteristics defined by graphs C or E at light engine load, with those defined by graph D for heavy engine load, the amount of fuel to be injected can be adjusted with the desired dynamic range, of the order of 20, in accordance with the goal set out in the preamble of the present description.

The engine management unit calculates, as a function of the engine load, the values of the fuel pressure to be established and the times $T_1$ and $T_2$ that apply to each fuel injection event. These values $T_1$ and $T_2$ are transmitted, by links of the SPI or CAN type for example, to the injector control circuit which shapes the time profile of the current to be applied to the injector accordingly.

Of course, the invention is not restricted to the embodiment described and depicted which has been given solely by way of example. Thus, the advantageous precharging of the coil prior to the application of the current spike is not, however, indispensable, the invention thus also applying to an injector supplied with a current the profile of which does not have this precharging. Likewise, the invention applies to injectors supplied with fuel at variable pressure and to injectors supplied at constant pressure. In the case of a fault in the regulation of the fuel pressure, the upper value thereof is normally limited by the preload of a safety valve. The increase, according to the invention, in the duration of the current spike with the increase in fuel pressure to this upper value therefore establishes a "degraded mode" of operation of the supply of fuel to the injectors.

What is claimed is:

1. A method for controlling the amount of fuel (Q) injected into a direct-injection internal combustion engine by an injector supplied with fuel under pressure ($P_{fuel}$), the opening of said injector being triggered electromagnetically by supplying an electric coil that forms part of the injector with a predetermined current profile, this method being characterized in that:

the supply to the coil is commanded in such a way as to obtain a current spike of a predetermined duration ($T_1$), said duration ($T_1$) of said current spike being an increasing function of said fuel pressure ($P_{fuel}$), a rapid decrease in the strength of the current is then commanded, the duration ($T_2$) of said decrease being a function of said duration ($T_1$) and of the voltage of the source of electrical power that powers said injector, and the current is stabilized for a predetermined holding time, at a roughly constant value that is an increasing function of the fuel pressure ($P_{fuel}$).

2. The method as claimed in claim 1, characterized in that said duration ($T_1$) of said current spike is also a function of the duration of a predetermined injector-open time ($T_i$).

3. The method as claimed in claim 1, characterized in that the duration ($T_1$) of said current spike ranges from about 200 $\mu$s for a fuel pressure ($P_{fuel}$) of about 50 bar to about 600 $\mu$s for a fuel pressure ($P_{fuel}$) of about 120 bar.

4. The method as claimed in claim 1, characterized in that said coil is precharged prior to the application of said current spike.

5. The method as claimed in claim 2, characterized in that said coil is precharged prior to the application of said current spike.

6. The method as claimed in claim 3, characterized in that said coil is precharged prior to the application of said current spike.

* * * * *